US006057533A

United States Patent [19]

Ahn

[11] Patent Number: 6,057,533

[45] Date of Patent: May 2, 2000

[54] CONTROL PANEL OF A MICROWAVE OVEN HAVING SLIDE TYPE POWER CONTROL KNOB

[75] Inventor: Ki-pyo Ahn, Suwon, Rep. of Korea

[73] Assignee: Samsung Electronics Co., Ltd., Suwon, Rep. of Korea

[21] Appl. No.: 09/158,789

[22] Filed: Sep. 23, 1998

[30] Foreign Application Priority Data

May 13, 1998 [KR] Rep. of Korea ..... 98-17101
May 13, 1998 [KR] Rep. of Korea ..... 98-17104

[51] Int. Cl.[7] ..... H05B 6/68

[52] U.S. Cl. ..... 219/719; 219/702; 219/715; 200/38 FA

[58] Field of Search ..... 219/702, 719, 219/720, 718, 715; 200/38 FA

[56] References Cited

U.S. PATENT DOCUMENTS

| | | | |
|---|---|---|---|
| 3,848,105 | 11/1974 | Mori | 219/719 |
| 4,042,903 | 8/1977 | Finegan, Jr. | 200/330 |
| 4,129,769 | 12/1978 | Takagi et al. . | |
| 4,133,998 | 1/1979 | Otani . | |
| 4,177,370 | 12/1979 | Otani . | |
| 4,366,357 | 12/1982 | Satoh | 219/718 |
| 4,814,588 | 3/1989 | Hotta et al. . | |
| 5,097,105 | 3/1992 | Boin et al. | 219/702 |

FOREIGN PATENT DOCUMENTS

| | | |
|---|---|---|
| 1-88204 | 6/1989 | Japan . |
| 3-57305 | 6/1991 | Japan . |
| 9-273756 | 10/1997 | Japan . |

*Primary Examiner*—Philip H. Leung
*Attorney, Agent, or Firm*—Burns, Doane, Swecker & Mathis, L.L.P.

[57] ABSTRACT

Disclosed is a control panel of a microwave oven comprising a panel body, a timing device, a time control knob, and a power control knob assembly. The power control knob assembly has a pinion assembled with the power control shaft, a rack engaged with the pinion, and a knob installed slidably along a guiding recess formed on the panel body so as to move the rack linearly. As the knob is slide along the guide recess of the panel body of tie panel, the rack moved by the knob rotates the pinion. Accordingly, the output control shaft is rotated, and thereby the output power degree of the microwave is set. As described, knob of the power control knob assembly for controlling the output power of the microwave is linearly moved. Accordingly, the user can easily distinguish the power control knob from the time control knob.

8 Claims, 4 Drawing Sheets

CONTROL PANEL OF A MICROWAVE OVEN HAVING SLIDE TYPE POWER CONTROL KNOB

BACKGROUND OF THE INVENTION

1. Field of the Invention

The present invention relates to a microwave oven, and more particularly to a control panel of a microwave oven having a slide type power control knob assembly which allows a user to easily distinguish the same with other controlling assemblies such as a time control knob.

2. Description of the Prior Art

Generally, a microwave oven is an appliance for cooking a food with microwave of high frequency. Recently, the microwave oven is popular for its advantage that it cooks the food in a relatively short period of time and maintains the original shape of a cooked object.

Such a microwave oven is comprised of a body 1 and a control panel 10 formed at a front side of the body 1. The control panel 10 is formed with a switch 11 for starting/stopping the operation of the microwave oven, a power control knob 12 for controlling the output power of the microwave, and a time control knob 13 for presetting a period of time in which the microwave is projected to the food.

More advanced type of microwave oven would be installed with a plurality of other selection switches for presetting other data proper to respective operational conditions thereof and choosing such preset data when needed.

A power control knob 12 is connected with a power control shaft of a timing device (not shown). The timing device controls the output power of the microwave by controlling the electric power to be supplied intermittently to the magnetron according to the set condition of the power control knob.

The time control knob 13 is connected with a time control shaft of the timing device. The magnetron is operated within a time preset by the time control knob 13.

Reference numeral 2 in the drawing indicates a door, and 3 indicates a rotatable tray whereon the food to be cooked is loaded.

In the conventional microwave oven, however, both of the power control knob and the time control knob are in the similar circular shape, so a user cannot easily distinguish one from the other. This means that the user has to take special care in order to operate right knob between the power control knob and the time control knob.

SUMMARY OF THE INVENTION

The present invention has been made to overcome above problem, and accordingly, it is an object of the present invention to provide a microwave oven with a slide type power control knob allowing a user to easily distinguish the same from the circular dial type knob.

In order to accomplish above object, the control panel of the microwave oven according to the present invention comprises a panel body installed at a front side of a microwave oven; a timing device installed at a rear side of said panel body, said timing device having a power control shaft for controlling electric power supplied to a magnetron and a time control shaft being extended toward a front of said panel body and passing through said panel body; a time control knob engaged with said time control knob at a front of said panel body; and a power control knob assembly having a pinion assembled with said power control shaft, a rack engaged with said pinion, and a knob installed slidable. along a guiding recess formed on said panel body so as to move said rack linearly.

As the knob is slide along the guide recess of the panel body of the panel, the rack moved by the knob rotates the pinion. Accordingly, the output control shaft is rotated, and thereby the output power degree of the microwave is set.

As described, knob of the power control knob assembly for controlling the output power of the microwave is linearly moved. Accordingly, the user can easily distinguish the power control knob from the time control knob.

BRIEF DESCRIPTION OF THE DRAWINGS

Above objects and advantages of the present invention will be more apparent by describing a preferred embodiment with reference to the accompanying drawings, in which.

DETAILED DESCRIPTION OF THE PREFERRED EMBODIMENT

Figure 1:
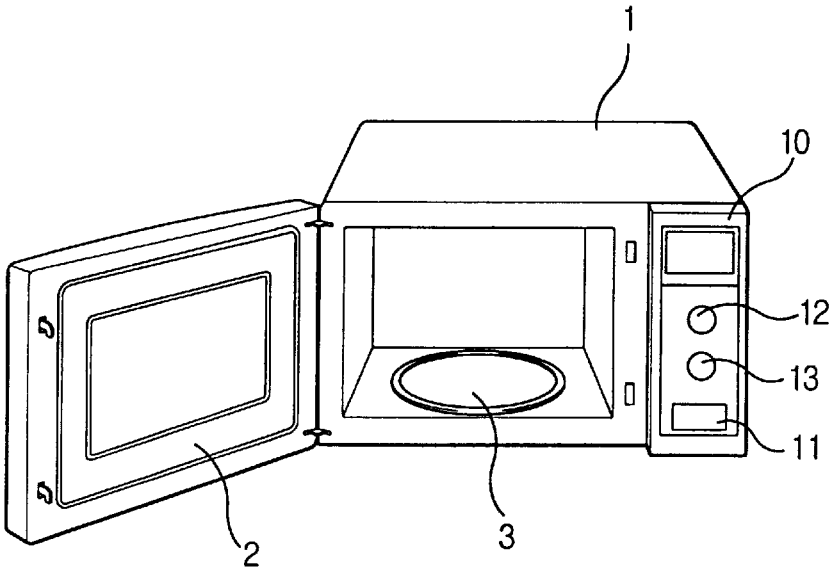
FIG. 1 (PRIOR ART)
FIG. 1 is a perspective view of a general microwave oven.
Figure 2:
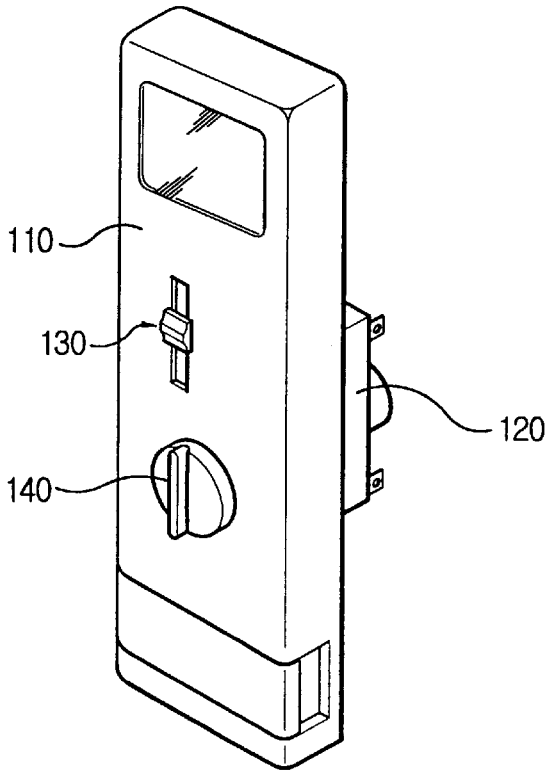
FIG. 2 is a perspective view showing a control panel of a microwave oven according to the first embodiment of the present invention.
Figure 3:
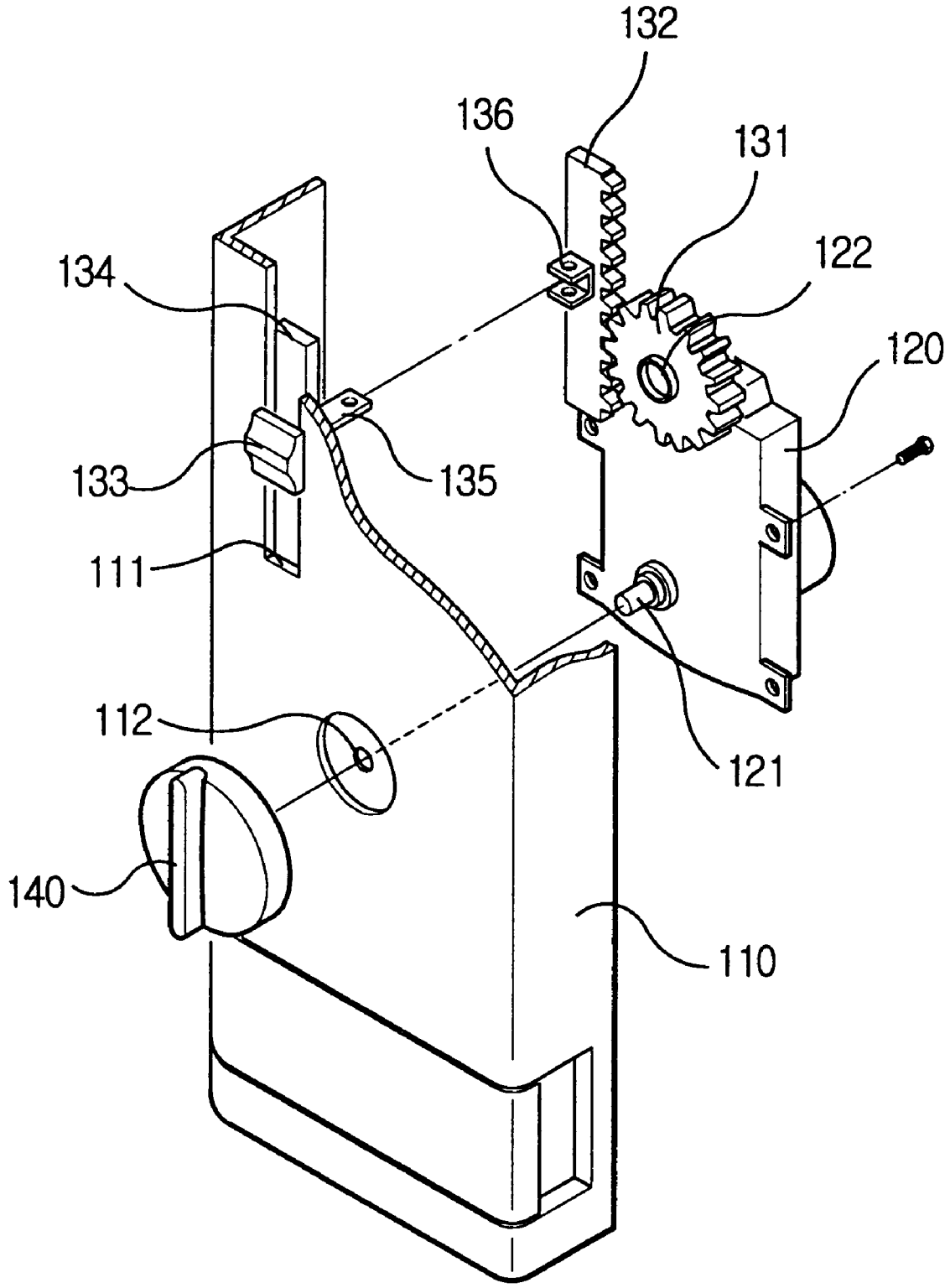
FIG. 3 is an exploded perspective view showing a main part of FIG. 2 in greater detail.

FIGS. 2 and 3 show a control panel of a microwave oven according to the first preferred embodiment of the present invention.

As shown, the control panel according to the first embodiment of the present invention comprises a panel body 110, a timing device 120, a time control knob 140, and a power control knob assembly 130.

The timing device 120 has a power control shaft 122 through which output power is set, and a time control shaft 121 through which operation time is set. The time control shaft 121 is extended to a front of the panel body 110 through a hole 112 formed on the panel body 110. The end of the time control shaft 121 is engaged with the time control knob 140 of a circular shape.

The power control knob assembly 130 comprises a knob 133, a rack 132, and a pinion 131.

The knob 133 is installed to be capable of sliding linearly along a linear a guiding recess 111 formed at a side portion of the panel body 110 whereby the travel path of the knob 133 is parallel to the recess 111. Although the guiding recess 111 is vertically formed in the drawing, the same can also be horizontally formed.

At the rear side of the knob 133 a screen 134 is assembled. The screen 134 screens an internal parts so that the same are not shown through the guiding recess 110. Preferably, the screen 134 is large enough to completely cover the guiding recess 110 even when the knob 133 is positioned at an end of the guiding recess 110.

A rear surface of the screen is attached with a rack 132 which is formed with a gear at a side thereof. The screen 134 and rack 132 are engaged with each other by ribs 135 and 136. The screen rib 135 is protruded from the rear surface of the screen 134, while the rack rib 136 is protruded from the front surface of the rack 132. More specifically, respective ribs 135 and 136 are formed with holes, through which coupling members such as a bolt, a rivet or the like (not shown) is inserted.

Meanwhile, the pinion 131 is assembled with the power control shaft 122 of the timing device 120, and engaged with the rack 132.

The operation of the first embodiment of the present invention is follows.

First, in order to control the output power of the microwave frequency, a user moves the knob 133 of the power control knob assembly along the guiding recess 11 of the panel body 110 to an extent he wants. As the knob 133 is moved, the rack 132 engaged therewith by ribs 135 and 136 is consequently moved. Also, as the rack 132 is moved, the pinion 131 is rotated. Accordingly, the power control shaft 21 is rotated, so the timing device 120 is set.

In addition, the time control knob 140 is rotated in order to set the period of time that the microwave is projected onto the cooked object.

Figure 4:
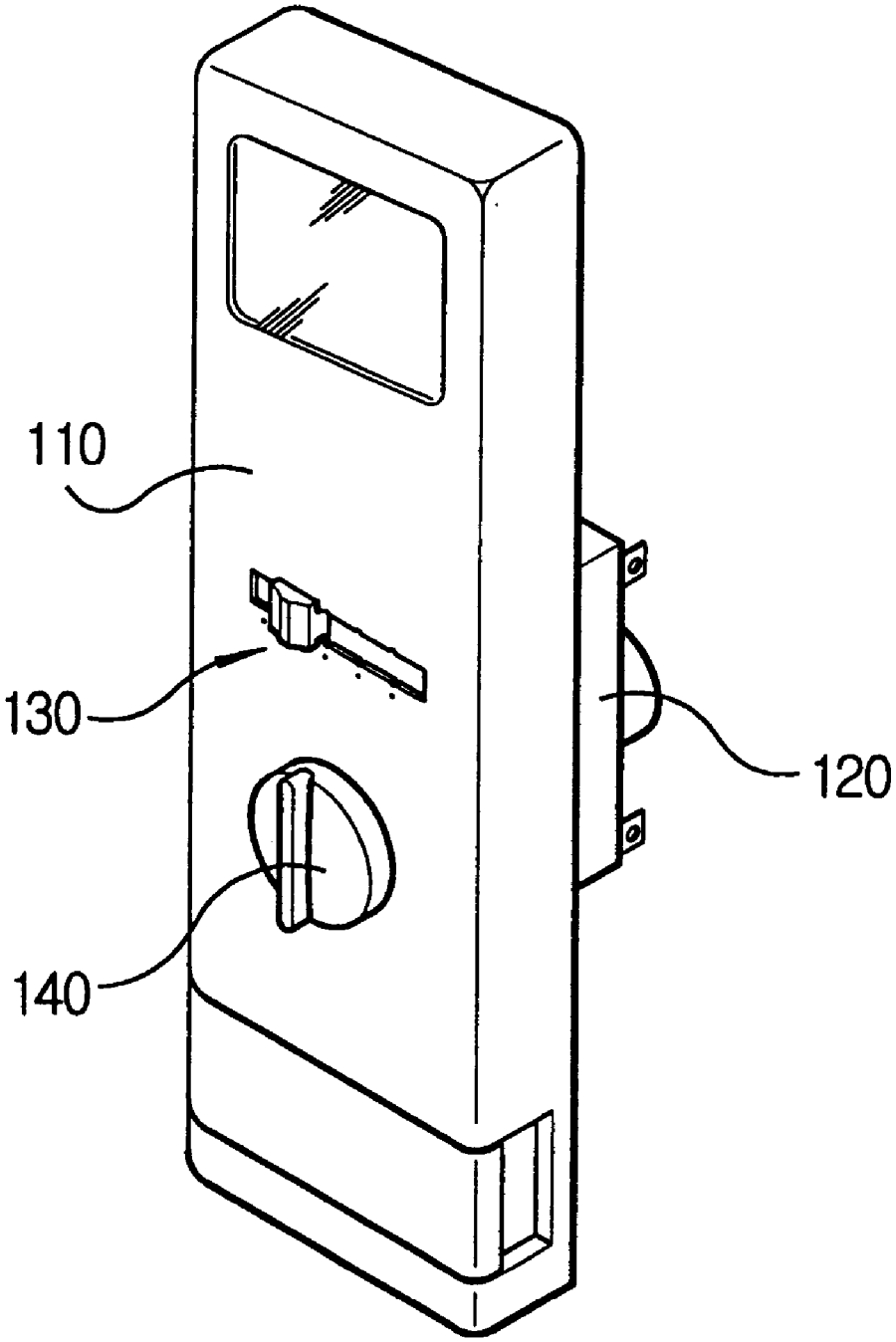
FIG. 4 is a perspective view showing a control panel of a microwave oven according to the second embodiment of the present invention.
Figure 5:
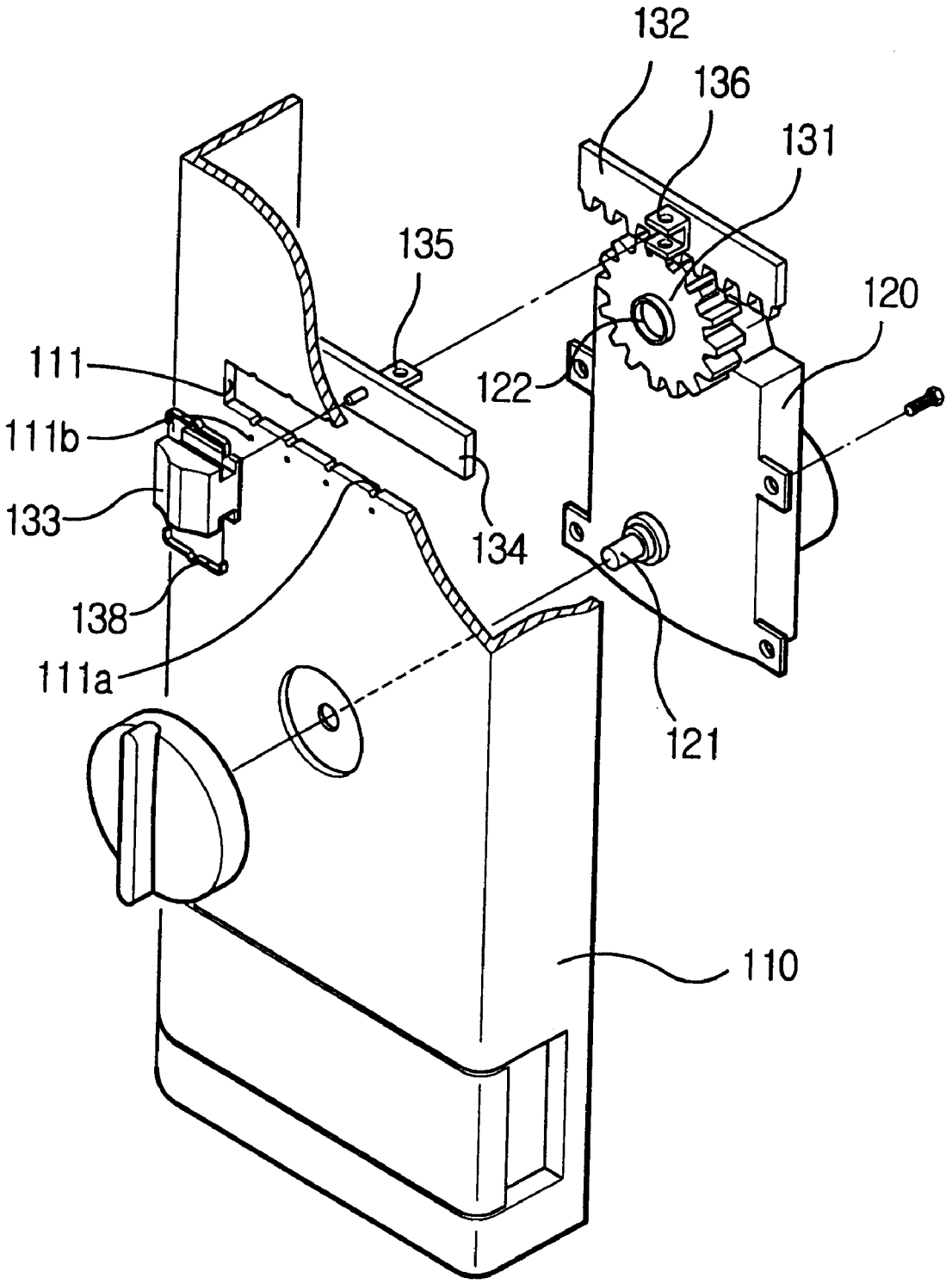
FIG. 5 is an exploded perspective view showing a main part of FIG. 4 in greater detail.

Meanwhile, FIGS. 4 and 5 show a control panel of a microwave oven according to the second embodiment of the present invention.

As shown, the control panel according to the second embodiment of the present invention is constructed in a similar manner with that of the first embodiment. Therefore, additional description of the same part will be omitted.

Attentions are now invited to a particular aspect of the second embodiment of the present invention, i.e., the horizontally formed power control knob. According to the second embodiment of the present invention, a guiding recess 111' of the panel body is horizontally formed, along which a plurality of locking holes 111*a*' are formed. The locking holes 111*a*' are spaced from each other to a predetermined interval therebetween. A lot of dots 111*b*' are printed at the lower side of the locking holes 111*a*' on the panel body 110. The dots 111*b*' shows the degree of the output power of the microwave.

In addition, the knob 133' is attached with elastic members 138' at upper and lower sides thereof. The protrusions formed on the elastic member 138' are locked into locking holes 111*a*' of the guiding recess 111'.

According to the second embodiment of the present invention, the knob 133' is moved by a predetermined interval due to protrusions formed on the elastic member 138' attached on the knob 133'. That is, while the knob 133' is moved along the guiding recess 111' of the panel body 110', the protrusions formed on the elastic member 138' are locked into the locking hole 111*a*' so that the frequency regulating knob 133' is permitted to stop at a predetermined spot.

As described, the power control knob for controlling output power of the microwave is moved in a horizontal direction. Accordingly, the user easily distinguishes the horizontally formed power control knob from the time control knob which is in the circular shape.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A control panel of a microwave oven comprising:

a panel body installed at a front side of a microwave oven;

a timing device installed at a rear side of said panel body, said timing device having a power control shaft for controlling electric power supplied to a magnetron and a time control shaft being extended toward a front of said panel body and passing through said panel body;

a time control knob engaged with said time control knob at a front of said panel body; and a power control knob assembly having a pinion assembled with said power control shaft, a rack engaged with said pinion and arranged for movement in a linear direction for rotating said pinion, and a power knob slidable linearly along a linear guiding recess formed in said panel body and connected to said rack so as to move said rack linearly, a linear travel path of said power knob being parallel to said recess.

2. The control panel of a microwave oven an claimed in claim 1, wherein the guiding recess of said panel body is vertically formed.

3. The control panel of a microwave oven as claimed in claim 1, wherein the guiding recess of said panel body is horizontally formed.

4. The control panel of a microwave oven as claimed in claim 1, wherein said knob and said rack have coupling holes, and are engaged with each other by a pair of coupling ribs which are respectively extended from a rear surface and a front surface thereof.

5. The control panel of a microwave oven as claimed in claim 1, wherein said power control knob assembly further comprises a screen attached to a rear surface of said knob for covering an opening defined by the guiding recess, said screen being slidable along a linear path extending parallel to the recess.

6. The control panel of a microwave oven as claimed in claim 5, wherein said screen is long enough to cover the opening defined by the guiding recess.

7. The control panel of a microwave oven as claimed in claim 1, wherein the guiding recess is formed with a plurality of locking holes along therewith, and said knob has an elastic member on which a plurality of protrusion are formed to be locked into the locking holes of the guiding recess.

8. The control panel of a microwave oven as claimed in claim 7, wherein locking holes of the guiding recess is formed at both sides of the guiding recess.

* * * * *